US005308915A

United States Patent [19]

Ohya et al.

[11] Patent Number: 5,308,915

[45] Date of Patent: May 3, 1994

[54] ELECTRONIC MUSICAL INSTRUMENT UTILIZING NEURAL NET

[75] Inventors: Kenichi Ohya; Hirofumi Mukaino, both of Hamamatsu, Japan

[73] Assignee: Yamaha Corporation, Hamamatsu, Japan

[21] Appl. No.: 779,110

[22] Filed: Oct. 18, 1991

[30] Foreign Application Priority Data

Oct. 19, 1990 [JP] Japan ..... 2-282854
Oct. 29, 1990 [JP] Japan ..... 2-293058

[51] Int. Cl.[5] ..... G10H 7/00

[52] U.S. Cl. ..... 84/601; 395/22; 395/902

[58] Field of Search ..... 395/22, 902, 927; 84/600-603

[56] References Cited

U.S. PATENT DOCUMENTS

| | | | |
|---|---|---|---|
| 4,941,122 | 7/1990 | Weideman | 364/807 |
| 4,953,099 | 8/1990 | Jourjine | 364/513 |
| 5,033,006 | 7/1991 | Ishizuka et al. | 364/513 |
| 5,138,924 | 8/1992 | Ohya et al. | 84/604 |
| 5,138,928 | 8/1992 | Nakajima et al. | 84/635 |

OTHER PUBLICATIONS

Johnson, Margaret L. "Toward an Expert System for Expressive Musical Performance", *Computer*, Jul. 1991, pp. 30-34.

"The Representations of Pitch in a Neural Net Model of Chord Classification", B. Laden and D. Keefe, 13 *Computer Music J.* 12 (Winter 1989).

"A Connectionist Approach to Algorithmic Composition", P. Todd, 13 *Computer Music J.* 27 (Winter 1989).

*Primary Examiner*—William M. Shoop, Jr.
*Assistant Examiner*—Jeffrey W. Donels
*Attorney, Agent, or Firm*—Spensley Horn Jubas & Lubitz

[57] ABSTRACT

An electronic musical instrument utilizing neural nets comprises parameter input device for inputting a parameter and a neural net device for calculating the parameter. The neural net device is in advance learning therefore, any input parameter results in proper output by interpolation. The instrument further comprises a weighting data memory, the weighting data being provided to the neural net device. The output of the neural net device is interpreted by an interpreter using interpretation knowledge stored in a memory, thereby the output of the neural net device being changed to musical values. Further, the musical values are modified by an output modifier using modification knowledge stored in another memory so as to be accepted musically. The weighting data, the interpretation knowledge and the modification knowledge can be selected by use of selectors, thus use of the selectors expands musical variation.

33 Claims, 7 Drawing Sheets

BEST AVAILABLE COPY

BEST AVAILABLE COPY

ELECTRONIC MUSICAL INSTRUMENT UTILIZING NEURAL NET

BACKGROUND OF THE INVENTION

1. Field of the Invention

The present invention relates to an electronic musical instrument utilizing neural nets more particularly, to an electronic musical instrument to generate musical patterns, such as a rhythm pattern and a bass pattern, using a neural net.

2. Description of the Prior Art

In a conventional electronic musical instrument having the function of an automatic rhythm pattern generation or an automatic accompaniment pattern generation, the patterns to be generated are previously stored in a memory. When any pattern is selected by a performer, the pattern is read from the memory and supplied to a musical tone generating circuit.

As described above, the conventional electronic musical instruments have only had a memory to generate musical patterns, such as a rhythm pattern and a bass pattern, so that available patterns are limited. Therefore, the musical representations have been scanty.

SUMMARY OF THE INVENTION

It is therefore an object of the present invention to provide an electronic musical instrument which allows itself to generate more musical patterns by use of a neural net.

In accordance with the present invention, an electronic musical instrument utilizing neural nets comprises parameter input means for inputting a parameter, a neural net device for utilizing the parameter inputted from the parameter input means with internal organization, and change means for changing output data from the neural net device into musical pattern signal.

In the above-mentioned instrument, the neural net device is in advance learning, therefore, any input parameter results in a proper output by interpolation.

DETAILED DESCRIPTION OF THE PREFERRED EMBODIMENT

Figure 1:
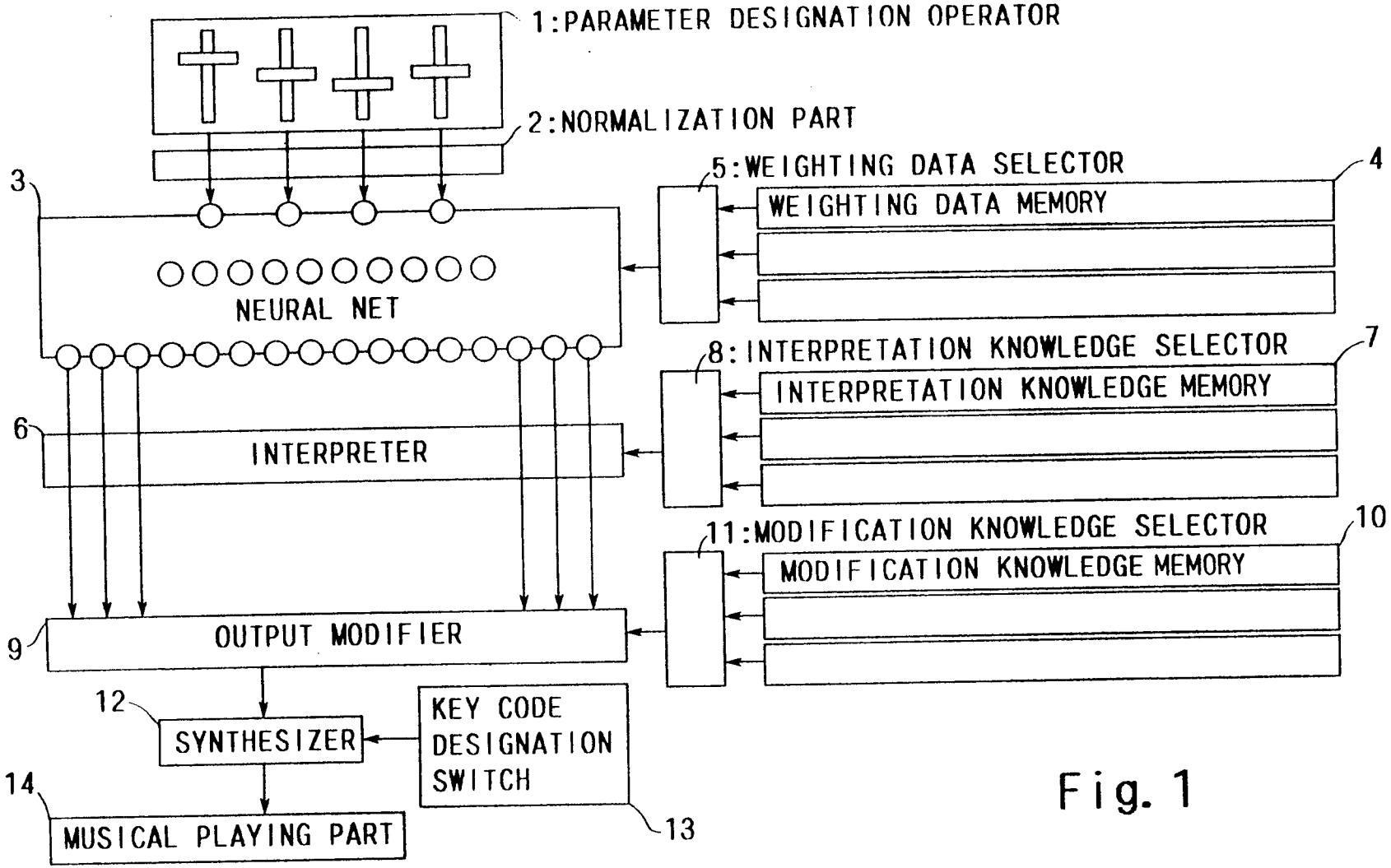
FIG. 1 is a block diagram of a rhythm pattern generating instrument embodying the present invention.

Referring to the drawings, a rhythm pattern generating instrument embodying the present invention is disclosed in detail as follows.

This rhythm pattern generating instrument is provided with a parameter designation operator 1, a normalization part 2, a neural net 3, weighting data memory 4 for storing various weighting data, a weighting data selector 5 for selecting weighting data in the weighting data memory 4, an interpreter 6, an interpretation knowledge memory 7 for storing various interpretation knowledge, an interpretation knowledge selector 8 for selecting interpretation knowledge, an output modifier 9, a modification knowledge memory 10 for storing various modification knowledge, a modification knowledge selector 11 for selecting modification knowledge, a musical playing data synthesizer 12, a key code designation switch 13, and a musical playing part 14.

The parameter designation operator 1 has four volumes, each of which sets a musical parameter. The musical parameters depend on the learning mode of the neural net 3. In the learning mode previously performed, a plurality of data sets of parameters and output data are supplied successively to the neural net 3. It is unnecessary to give basic musical sense to the parameters in the learning mode of the neural net 3. The learning process is usually carried out by use of a back-propagation method.

The parameter designation operator includes an analog-digital converter to output digital values.

The normalization part 2 normalizes the output of the parameter designation operator 1 to use it as input data to the neural net 3. The normalized data is given to each neuron of an input layer of the neural net 3.

The neural net 3 consists of three layers, the input layer, a middle layer, and an output layer. Each neuron of the layers is combined with an adjacent neuron at a certain weighting factor. The number of the neurons of the input layer is equal to the number of parameters of the parameter designation operator 1. The number of the neurons of the middle layer is decided depending on a degree of the learning. In this example, the number of the neurons of the middle layer is twenty.

The number of the neurons of the output layer is decided depending on time resolution of the neural net 3. In the case of M bars output at Nth note notch, the number of notes is equal to N*M per one channel. In the example, notes of a bass drum tone color and a hi-hat tone color are generated at the first channel: notes of a snare drum tone color and a tom tom tone color are generated at the second channel. As time resolution is in a notes pattern of one bar with sixteenth note are generated, the output layer needs 32 neurons (16*1*2(channels)=32).

The weighting data memory 4 stores a plurality of weighting data to comply with different music genre.

The weighting data selector 5 is operated by the performer to select a weighting data in the memory 4.

The interpreter 6 is used to interpret the value output from the neural net 3, thereby changing the value to musical feeling data, using the interpretation knowledge stated later. In this example, each output neuron is independent, not combined with the other output neurons.

The interpretation knowledge stored in the interpretation knowledge memory 7 is used to realize adjustment to some musical genres. In this example, a plurality of sets of the interpretation knowledge is stored in the memory 7.

The interpretation knowledge selector 8 is used to select one interpretation knowledge from the memory 7. The selector is operated by a performer.

The output modifier 9 is used to modify the output value of the interpreter 6 using the modification knowledge in the memory 10, thereby changing musically unacceptable values to musically acceptable values.

The modification knowledge stored in the modification knowledge memory 10 is used to realize adjustment to the musical genres. In this example, a plurality of modification knowledge sets is stored in the memory 10.

The musical playing data synthesizer 12 generates the actual musical playing data according to the output data from the output modifier 9.

The key code designation switch 13 is used to assign a key code to the output data from the output modifier 9.

The musical playing part 14 is an output device, such as an MIDI device, to actually output the musical playing data.

The following is a description of the operation of the above-mentioned rhythm pattern generating instrument.

Step 1—Initializing

The performer arbitrarily inputs parameters in the parameter designation operator 1 by use of the four volumes. Of course, the learning mode is, at this time, already carried out by the neural net 3.

The performer operates the weighting data selector 5 to input any weighting data in the memory 4 to the neural net 3 so as to match the output rhythm pattern to the playing song played by another instrument. The performer also operates the interpretation knowledge selector 8 to input any interpretation knowledge in the memory 7 to the interpreter 6 so as to match the output rhythm pattern to the playing data played by another instrument. Further, the performer operates the modification knowledge selector 11 to input any modification knowledge in the memory 10 to the output modifier 9 so as to match the output rhythm pattern to the playing data played by another instrument.

Step 2—Input to neural net

The parameters inputted by the parameter designation operator 1 are normalized with the normalization part 2, and transferred to the input neurons of the input layer in the neural net 3.

Step 3—Calculating in neural net

First, the values of the neurons of the middle layer are calculated using the weighting data specified by the selector 5. Next, the values of the neurons of the output layer are calculated using the values of the middle layer.

Middle neurons "$j$" =

$$\text{sigmoid}\ (\Sigma\ \text{input neurons "}i\text{"} * \text{weighting data "}ij\text{"})$$

Output neurons "$k$" =

$$\text{sigmoid}\ (\Sigma\ \text{middle neurons "}j\text{"} * \text{weighting data "}ik\text{"})$$

where, $$\text{sigmoid}\ (x) = 1/(1 + \exp(-x))$$

Step 4—Interpretation of output neurons

The values of the output neurons are modified using the selected interpretation knowledge so as to have the musical sense. The output neurons of the output layer are interpreted on time series. In the example, a set of sixteen neurons beginning from the first neuron in the output layer forms the first series, the remainder of another sixteen neurons forming the second series. Output data of each neuron corresponds to a sixteenth note. In neural net theory, the value of the neurons should be a real number of 0 to 1. However, the real number value is changed to integer value of 0 to 127 for convenience of calculation.

For example, the output neurons' values are interpreted as follows:

The first series (see FIG. 2):

| Output neurons' value: | Interpreted value: |
|---|---|
| 0 to 5 | ungenerating tone |
| 6 to 31 | hi-hat-close |
| 32 to 56 | hi-hat-open |
| 57 to 63 | bass drum (weak) |
| 64 to 69 | bass drum (strong) |
| 70 to 95 | hi-hat-close +bass drum (strong) |
| 96 to 127 | hi-hat-open +bass drum (strong) |

The second series (see FIG. 3):

| Output neurons' value: | Interpreted value: |
|---|---|
| 0 to 18 | ungenerating tone |
| 19 to 37 | low tom |
| 38 to 41 | snare drum (weak) |
| 42 to 60 | middle tom |
| 61 to 64 | snare drum (weak) |
| 65 to 83 | high tom |
| 84 to 87 | snare drum (weak) |
| 88 to 127 | snare drum (strong) |

The velocity of the hi-hat, snare drum, and each tom are decided according to the neuron's value.

Figure 2:
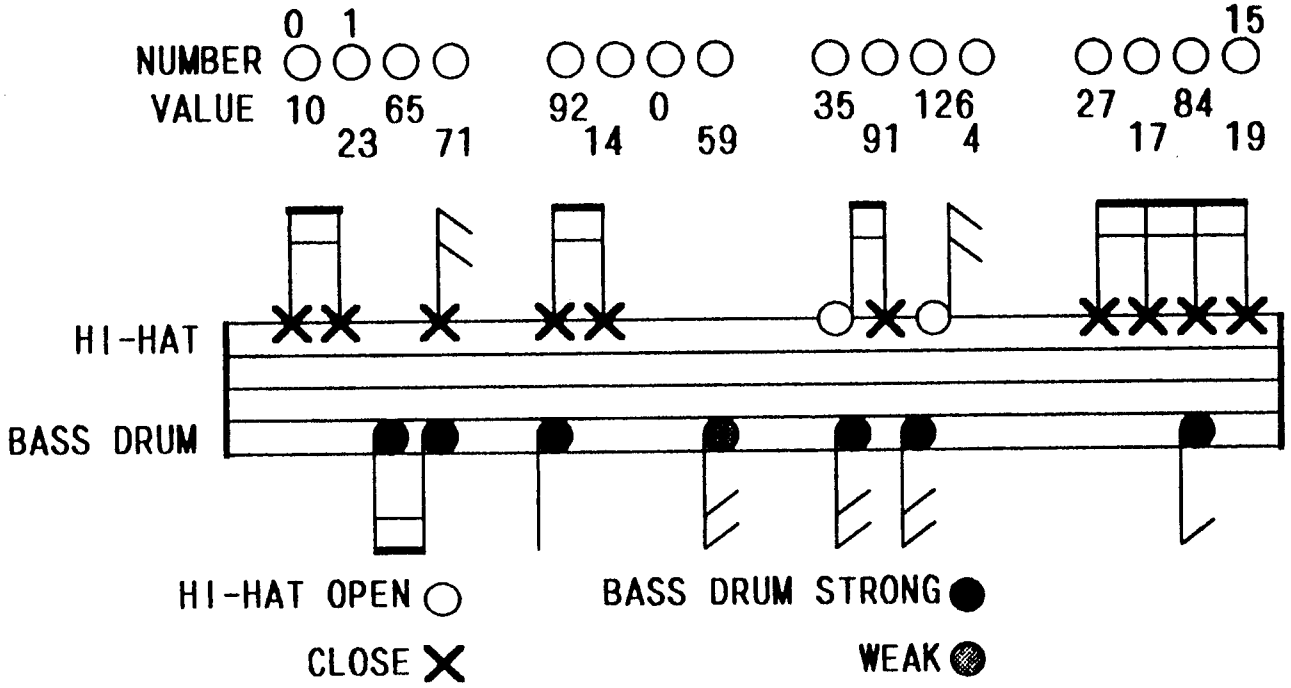
FIG. 2 shows correlation between the first series' neurons and the rhythm pattern.
Figure 3:
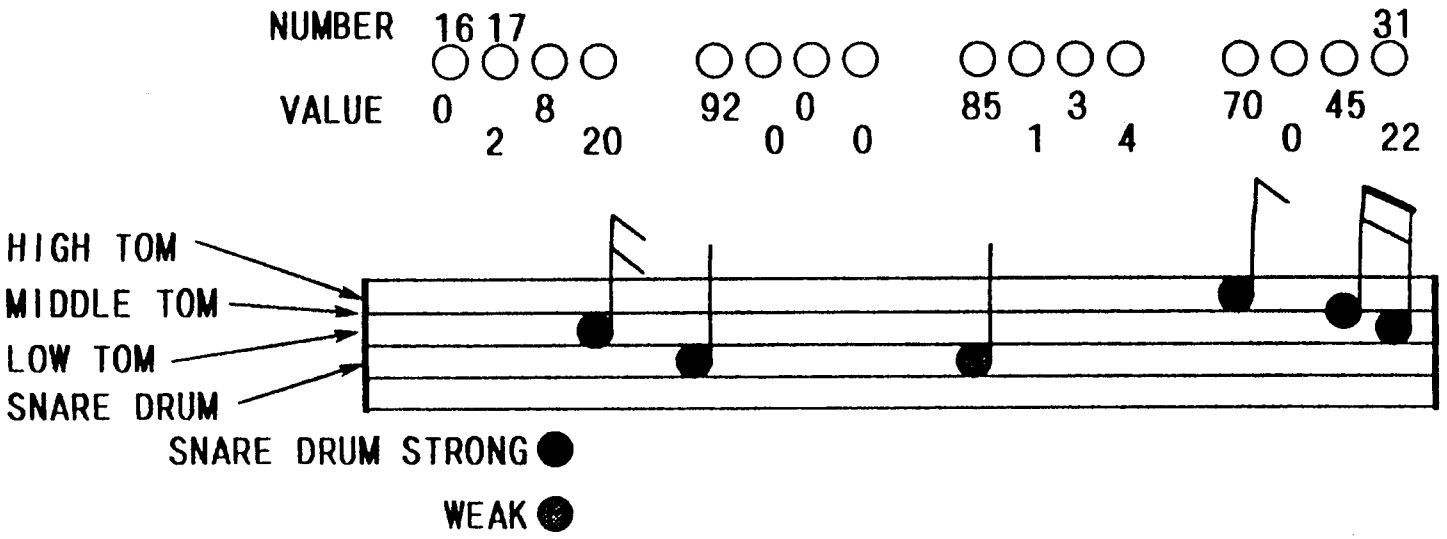
FIG. 3 shows correlation between the second series' neurons and the rhythm pattern.

FIG. 2 and FIG. 3 show correspondences between the first series and the rhythm pattern, and the second series and the rhythm pattern, respectively. The numbers 0 to 31 represent the output neuron's number.

Step 5—Output modification

In this step, the interpreted data (value) output from the interpreter 6, is modified to the value which can be musically accepted using the selected modification knowledge in the memory 10. For example, if a tone is generated at the timing corresponding to the back beat of sixteenth beat in an eight beat music score, the modification is done so that the back beat is released. Furthermore, If the hi-hat will keep open state after interpretation, the hi-hat is closed without open.

Step 6—Synthesizing playing data

The modified data output from the output modifier 9 is represented with velocity value of the tone color (i.e., an instrument name, such as hi-hat, bass drum). The key code switch 13 gives a key code of the tone color to the synthesizer 12 to change it to the musical playing data which can be actually performed. The musical playing part 14 receives the data from the synthesizer 12 and performs the musical playing data.

As mentioned above, adjusting the volume of the parameter designation operator 1 allows various rhythm patterns to be outputted.

Figure 4:
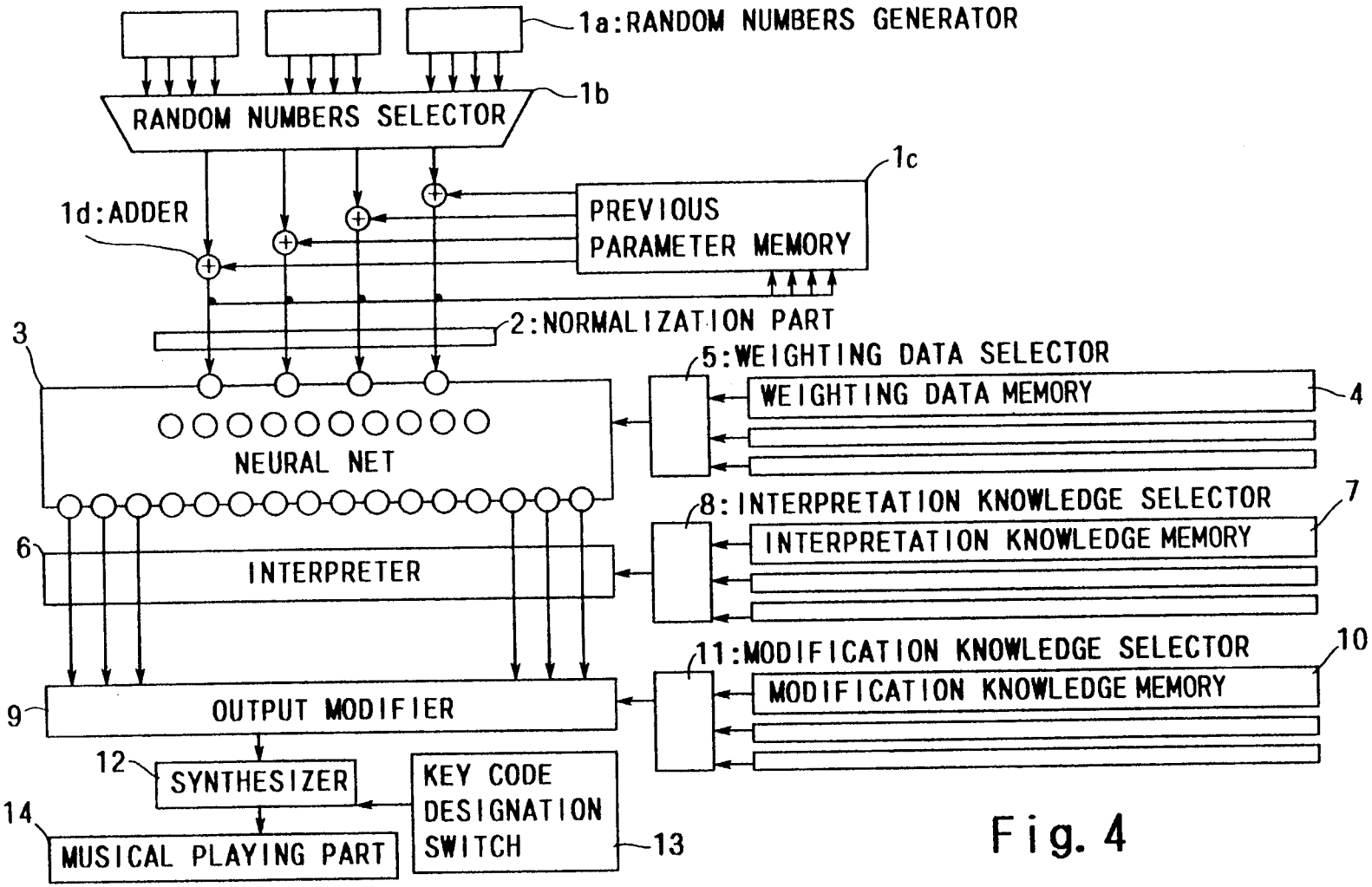
FIG. 4 is a block diagram of another rhythm pattern generating instrument embodying the present invention.

FIG. 4 is another example of the present invention.

The rhythm pattern generating instrument shown in FIG. 4 is provided with a group of random numbers generators 1*a*. The rhythm pattern generating instrument differs from the example shown in FIG. 1 in that this instrument is provided with a group of random numbers generators 1*a*, a random numbers selector 1*b* for selecting the random numbers generator, a previous parameter memory 1*c*, and an adder 1*d*.

The group of random numbers generators 1*a* is configured with a plurality of random numbers generator each of which generates digital random numbers with different distribution. The random numbers selector 1*b* is provided for selecting one random numbers generator in the group of the random numbers generators 1*a*. The previous parameter memory 1*c* stores previously used parameters which were used as input data to the neural net 3.

The adder 1*d* is used to add the value of the previous parameter memory 1*c* to the output value of the random numbers selector 1*b* to form a new parameter. This new parameter is stored into the previous parameter memory 1*c* as a previous parameter for the next time.

The normalization part 2 and the other parts, such as the neural net 3, and weighting data memory 4, are the same as the instrument in FIG. 1.

The following is a description of the process of the above-mentioned instrument.

Step 1—Initialization

A performer arbitrarily inputs initial parameters into the previous parameter memory 1*c*, and then, selects a random numbers generator to get rhythm patterns changing as expected.

The performer operates the weighting data selector 5 to input any weighting data in the memory 4 to the neural net 3 so as to match the output rhythm pattern to the playing song played by another instrument. The performer also operates the interpretation knowledge selector 8 to input any interpretation knowledge in the memory 7 to the interpreter 6 so as to match the output rhythm pattern to the playing data played by another instrument. Further, the performer operates the modification knowledge selector 11 to input any modification knowledge in the memory 10 to the output modifier 9 so as to match the output rhythm pattern to the playing data played by another instrument.

Step 2—Input to neural net

The output of the adder in which the value of the previous parameter memory 1*c* is added to the output value of the random numbers selector 1*b* is fed to the normalization part 2 to normalize it. The output is also supplied to the previous parameter memory 1*c* to be stored as a previous parameter for next time. Therefore, if the selected random numbers generator distributes numbers non-uniformly, the parameter outputted from the adder 1*d* is shifted gradually from the first parameter given by the performer.

The process in the neural net 3 and the other processes in the example are the same previously stated in step 3 to 6.

Figure 5:
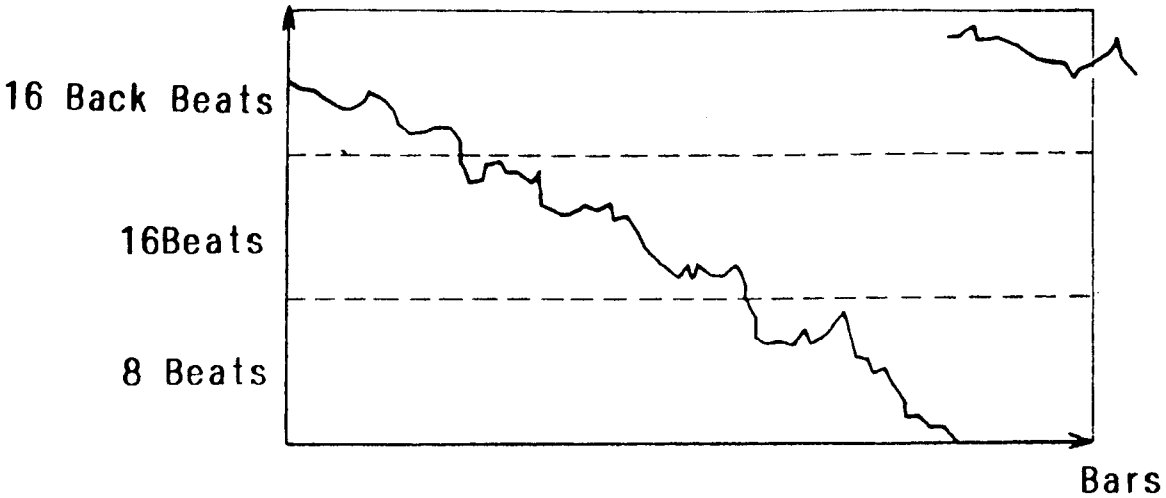
FIG. 5 is a graph showing change of the rhythm pattern in use of random numbers generator.

This example is characterized in that the rhythm output pattern, once initialized, is automatically changed without a performer's operation because the input patterns change with the random numbers, so that various trends of the rhythm patterns can be made using random numbers having different characteristics (distribution). For example, if random numbers distributed between −4 and +3 are added successively to the previous parameter in the memory 1*c* for every bar, parameter (number) is gradually decreased. In experiment, the parameter approximately decides a property of rhythm as follows,

| parameter (number) | rhythm |
|---|---|
| 0 to 40 | eight beats |
| 50 to 70 | sixteen beats |
| 80 to 100 | sixteen back beats |

so that if the process is advanced using the random number distributed between −4 and +3, i.e., the random number offset to a minus, after "100" is stored in the memory 1*c* as the first parameter, the parameter is gradually decreased, and then the rhythm pattern becomes a less tones pattern, the phenomenon of the rhythm pattern's change images a performer who is tired from playing a drum. While, if the parameter reaches "0" and underflow occurs, the parameter is increased gradually, the phenomenon of the rhythm pattern change images a performer who is getting well. FIG. 5 shows this state. If another type of random numbers is used, another pattern characteristic is obtained.

As another example, it is possible to input parameters for outputting a bass pattern from the parameter designation operator 1. In this case, the neural net 3 is learned so that the input parameters correspond to bass patterns, and the other elements, such as the interpretation knowledge, are properly configured.

The correlation between the output value of the neural net 3 and the bass tone is as follows:

| Output neuron's value (0 to 1): | Bass tone: |
|---|---|
| 0.00 to 0.35 | ungenerating tone (keep previous tone) |
| 0.35 to 0.45 | root tone (C) |
| 0.45 to 0.55 | third tone (E) |
| 0.55 to 0.65 | fourth tone (F) |
| 0.65 to 0.75 | fifth tone (G) |
| 0.75 to 0.85 | sixth tone (A) |
| 0.85 to 0.95 | seventh tone (B) |
| 0.95 to 1.0 | octave (C) |

Figure 6:
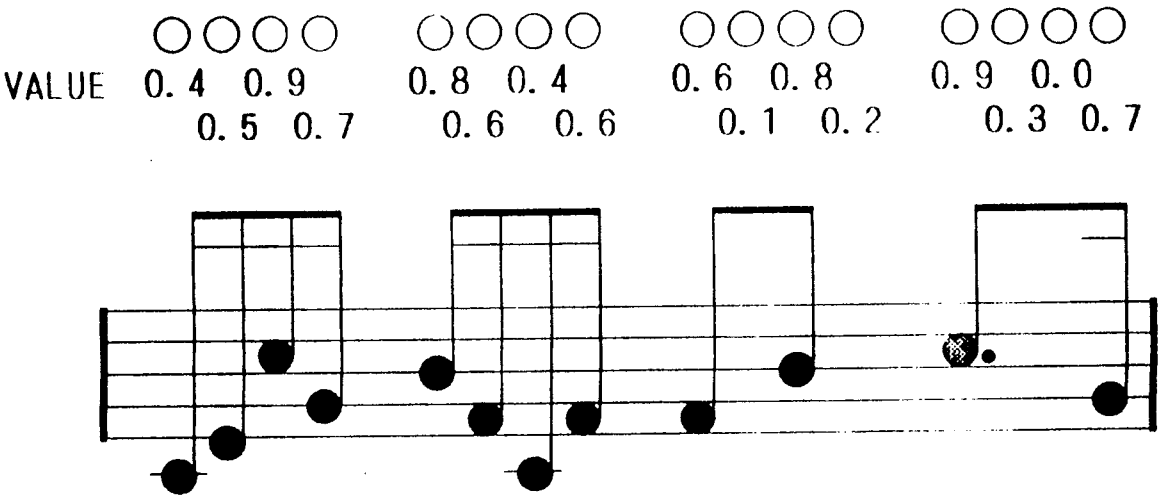
FIG. 6 shows correlation between the neurons and the bass pattern.

FIG. 6 shows a score according to the abovelisted correlation. The output modifier 9 is used to modify the output data from the interpreter 6 so as to be musically accepted. For example, any discordant tone is deleted or modified, and the rhythm is modified.

Figure 7:
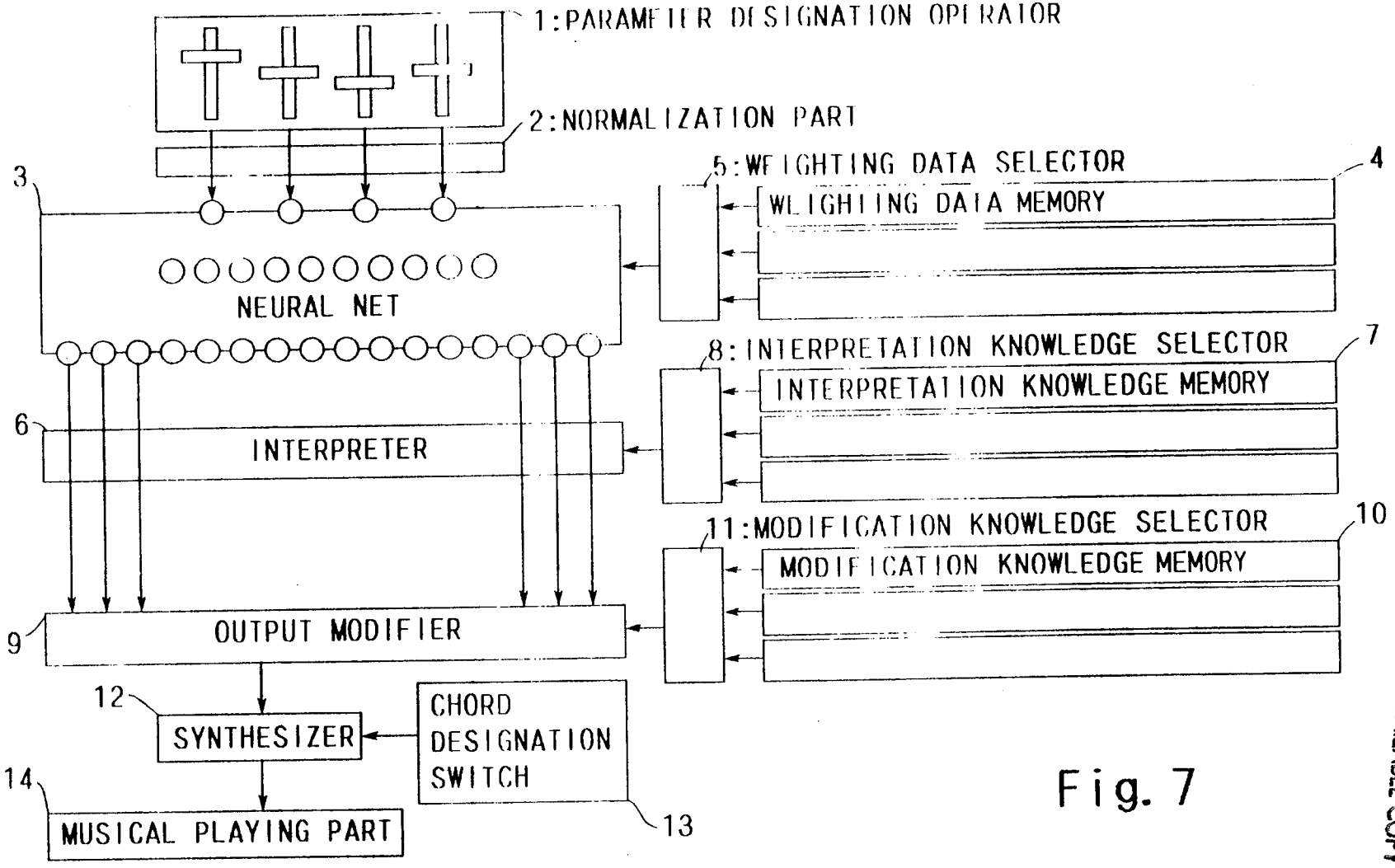
FIG. 7 is a block diagram of a bas pattern generating instrument embodying the present invention.

As the bass pattern outputted from the output modifier 9 is represented with an interval from a root tone of a chord, or with a tone pitch in "C" chord, it is necessary to change the tone pitch of the bass pattern according to the chord progress of music. This change performance is carried out by the musical playing data synthesizer 12 and a chord designation switch 13. FIG. 7 shows a block diagram of the above-mentioned example. In this diagram, the chord designation switch is different from the switch in FIG. 1.

Even if there is the same image music, an ideal bass pattern or a rule of the music is different depending on the music type. Therefore, the weighting data, the interpretation knowledge, and the modification knowledge are manually or automatically switched according to the music type. The key code can be inputted in a real time mode from the key code designation switch 13.

In this example, one bar of four beats is divided into sixteen, a bass tone being outputted at each timing. It is possible to generate bass patterns fully musical in an instrument arranged so as to be able to output bass tones for two bars, i.e., at each timing of thirty two timings.

As mentioned above, the neural net 3 not only plays back the learned patterns, but also generates middle patterns between two learned patterns, resulting in output patterns that give variety. Also, selecting the weighting data makes variation of velocity or the like, so that generated patterns give variety of rising and falling pitch, diminuendo and crescendo, and so on.

What is claimed is:

1. An electronic musical instrument utilizing neural nets, comprising:

parameter input means for providing a parameter;

a neural net device for utilizing said parameter provided by said parameter input means, said neural net device having a layer of output neurons for providing output data;

change means for changing said output data from said neural net device into a musical pattern signal, said change means including:

a. interpretation knowledge memory means for storing interpretation knowledge for interpreting said output data from said neural net device;

b. interpreter means for interpreting said output data from said neural net device as musical values using said interpretation knowledge;

c. modification knowledge memory means for storing modification knowledge for modifying said musical values from said interpreter means; and d. output modification means using said modification knowledge for modifying said musical vales from said interpreter means so as to be musically acceptable.

2. An electronic musical instrument utilizing neural nets according to claim 1, wherein said change means comprises modification knowledge selecting means for selecting modification knowledge in said modification knowledge memory.

3. An electronic musical instrument utilizing neural nets according to claim 1, wherein said change means comprises a musical playing data synthesizer for synthesizing actual musical playing data based on data output from said output modification means.

4. An electronic musical instrument utilizing neural nets according to claim 3, wherein said change means comprises a key code designation switch for providing to said musical playing data synthesizer a key code designated by a performer.

5. An electronic musical instrument utilizing neural nets according to claim 3, wherein said change means comprises a chord designation switch for providing to said musical playing data synthesizer a chord designated by a performer.

6. An electronic musical instrument utilizing neural nets, comprising:

parameter input means for providing a parameter;

a neural net device for utilizing said parameter provided by said parameter input means, said neural net device having a layer of output neurons for providing output data;

change means for changing said output data from said neural net device into a musical pattern signal, said change means including:

a. a weighting data memory for storing weighting data to be fed to said neural net device as a weighting factor for weighting said output data as musical values of said neural net;

b. weighting data selecting means for selecting said weighting data in said weighting data memory;

c. a modification knowledge memory for storing modification knowledge for modifying said musical values from said neural net; and d. output modification means using said modification knowledge for modifying said musical vales from said neural net so as to be musically acceptable.

7. An electronic musical instrument utilizing neural nets, comprising:

parameter input means for providing a parameter;

neural net device for utilizing the parameter provided by said parameter input means, said neural net device having a layer of output neurons for providing output data;

change means for changing said output data from said neural net device into a musical pattern signal; and modification means for storing modification knowledge to modify said musical pattern signal, and for modifying said musical pattern signal using said modification knowledge so as to be musically acceptable.

8. An electronic musical instrument utilizing neural nets according to claim 7, wherein said musical pattern signal is a rhythm pattern signal.

9. An electronic musical instrument utilizing neural nets according to claim 7, wherein said musical pattern signal is a bass pattern signal.

10. An electronic musical instrument utilizing neural nets according to claim 7, further comprising normalization means for normalizing said parameter provided by said parameter input means.

11. An electronic musical instrument utilizing neural nets according to claim 7, further comprising a weighting data memory for storing weighting data to be fed to said neural net device as a weighting factor of said neural net.

12. An electronic musical instrument utilizing neural nets according to claim 11, further comprising weighting data selecting means for selecting said weighting data in said weighting data memory.

13. An electronic musical instrument utilizing neural nets according to claim 7, wherein said change means comprises interpretation knowledge memory means for storing interpretation knowledge for interpreting said output data from said neural net device, and interpreter means for interpreting said output data from said neural net device as musical values using said interpretation knowledge.

14. An electronic musical instrument utilizing neural nets according to claim 13, wherein said change means comprises interpretation knowledge selecting means for selecting said interpretation knowledge in said interpretation knowledge memory means.

15. An electronic musical instrument utilizing neural nets. comprising:

parameter input means for providing a parameter, said parameter input means including a selectable random numbers generator for generating a random number as said parameter;

a neural net device for utilizing the parameter provided by said parameter input means, said neural net device having a layer of output neurons for providing output data; and change means for changing said output data from said neural net device into a musical pattern signal.

16. An electronic musical instrument utilizing neural nets according to claim 15, further comprising previous parameter memory means for storing a previous parameter, and adder means for adding said previous parameter in said previous parameter memory to a random number outputed from said random numbers generator, said adder having adder output being supplied to said neural net device and said previous parameter memory means to be stored as a next previous parameter.

17. An electronic musical instrument utilizing neural nets according to claim 15, wherein said random numbers generator generates random numbers with an offset distribution having a minus or a plus direction.

18. An electronic musical instrument utilizing neural nets, comprising:

parameter input means for providing a parameter;

a neural net device for utilizing the parameter provided by said parameter input means, said neural net device having a layer of output neurons for providing output data, said layer of output neurons comprising a plurality of output layer neurons respectively corresponding to tone generation timings of a set of musical tones to be generated;

change means for changing said output data from said neural net device into a musical pattern signal; and modification means for storing modification knowledge to modify said musical pattern signal, and for modifying said musical pattern signal using said modification knowledge so as to be musically acceptable.

19. An electronic musical instrument utilizing neural nets according to claim 18, wherein said output data of said plurality of neurons respectively represent tone colors of a set of musical tones to be generated.

20. An electronic musical instrument utilizing neural nets according to claim 18, wherein said output data of said plurality of neurons respectively represent tone pitches of a set of bass tones to be generated.

21. An electronic musical instrument utilizing neural nets according to claim 13, wherein said interpretation knowledge stored in said interpretation knowledge memory means indicates correspondence between a plurality of neurons in said neural net device and tone colors of a set of musical tones to be generated.

22. A method using an electronic musical instrument utilizing neural nets, comprising the steps of:

providing a parameter;

utilizing said provided parameter in a neural net device having a layer of output neurons;

providing output data from said layer of output neurons;

changing said output data from said neural net device into a musical pattern signal;

storing modification knowledge to modify said musical pattern signal; and modifying said musical pattern signal using said stored modification knowledge so as to be musically acceptable.

23. A method according to claim 22, wherein said musical pattern signal is a rhythm pattern signal.

24. A method according to claim 22, wherein said musical pattern signal is a bass pattern signal.

25. A method according to claim 22, further comprising the step of normalizing said provided parameter.

26. A method according to claim 22, further comprising the step of storing weighting data to be fed to said neural net device as a weighting factor of said neural net device.

27. A method according to claim 26, further comprising the step of selecting said stored weighting data.

28. A method according to claim 22, further comprises the steps of:

storing interpretation knowledge for interpreting said output data from said neural net device; and interpreting said output data from said neural net device as musical values using said stored interpretation knowledge.

29. A method according to claim 28, further comprising the step of selecting said interpretation knowledge from said stored interpretation knowledge.

30. A method according to claim 28, wherein said stored interpretation knowledge indicates a correspondence between a plurality of neurons in said neural net device and tone colors of a set of musical tones to be generated.

31. A method of using an electronic musical instrument utilizing neural nets, comprising the steps of:

selectably generating a random number as a parameter;

utilizing said parameter in a neural net device having a layer of output neurons for providing output data;

producing output data from said layer of output neurons; and changing said output data from said neural net device into a musical pattern signal.

32. A method according to claim 31, further comprising the steps of:

adding a stored previous parameter to said selectably generated random number to produce an adder output;

supplying said adder output as said parameter used by said neural net device; and storing said adder output as said previous parameter.

33. A method according to claim 31, further comprising the step of offsetting, in a minus or a plus direction, a distribution of said selectably generated random number.

* * * * *